US011454911B2

(12) United States Patent
Yoshimura

(10) Patent No.: US 11,454,911 B2
(45) Date of Patent: Sep. 27, 2022

(54) IMAGE FORMING APPARATUS CONTROLLING IMAGE FORMATION BASED ON A ZERO-CROSSING DETECTION SIGNAL

(71) Applicant: CANON KABUSHIKI KAISHA, Tokyo (JP)

(72) Inventor: Shotaro Yoshimura, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/144,872

(22) Filed: Jan. 8, 2021

(65) Prior Publication Data

US 2021/0223732 A1 Jul. 22, 2021

(30) Foreign Application Priority Data

Jan. 16, 2020 (JP) ..... JP2020-004842

(51) Int. Cl.
*G03G 15/00* (2006.01)

(52) U.S. Cl.
CPC ..... *G03G 15/5004* (2013.01); *G03G 15/80* (2013.01)

(58) Field of Classification Search
USPC ..... 399/37
See application file for complete search history.

(56) References Cited

U.S. PATENT DOCUMENTS

2015/0177656 A1* 6/2015 Yoshimura ..... G03G 15/55 399/33
2018/0196380 A1* 7/2018 Itoh ..... G03G 15/80

FOREIGN PATENT DOCUMENTS

JP 2014-89399 A 5/2014
JP 5712186 B 5/2015
JP 2015-121687 A 7/2015
JP 6348825 B2 * 6/2018 ..... G03G 15/2039

* cited by examiner

*Primary Examiner* — Quana Grainger
(74) *Attorney, Agent, or Firm* — Venable LLP

(57) ABSTRACT

The image forming apparatus includes a power supply unit configured to generate a DC voltage from an AC voltage and supply the DC voltage to a load, the image forming apparatus configured to perform image formation on a recording material, the image forming apparatus including a first control unit configured to control the image formation on the recording material, the power supply unit including a second control unit configured to control a voltage generation unit that generates the DC voltage from the AC voltage input from an AC power supply, a zero-crossing detection unit configured to detect a zero-crossing timing of the AC voltage according to the AC voltage input, and to output a zero-crossing detection signal, and a transmission unit configured to transmit the zero-crossing detection signal output from the zero-crossing detection unit to the first control unit.

15 Claims, 8 Drawing Sheets

T1
T2
T3
T4
T5
Vac ×√2

AC VOLTAGE
Vac
0

VOLTAGE
Ve′
0
t
t
t
t

ZERO-
CROSSING
TIMING
SIGNAL

DATA
SIGNAL
0

ZERO-
CROSSING
DETECTION
SIGNAL
0

| FIG. 7A |
| --- |
| FIG. 7B |

| FIG. 7A |
| --- |
| FIG. 7B |

IMAGE FORMING APPARATUS CONTROLLING IMAGE FORMATION BASED ON A ZERO-CROSSING DETECTION SIGNAL

BACKGROUND OF THE INVENTION

Field of the Invention

The present invention relates to an image forming apparatus such as a copier, a facsimile machine or a printer.

Description of the Related Art

An image forming apparatus that uses an electrophotographic process such as a copier, a facsimile machine or a printer includes a heat fixing apparatus that causes an unfixed toner image which was transferred onto a recording material to be heat-fixed on the recording material using a heater or the like. The types of heat fixing apparatuses that are generally known are a heating roller type that uses a halogen heater as a heat source, and a film heating type that uses a ceramic heater as a heat source. In an image forming apparatus that includes a heat fixing apparatus, the timing at which an input voltage from a commercial AC power supply becomes zero (hereinafter, referred to as "zero-crossing timing") is detected, and the electric power supply to a heater or the like from the commercial AC power supply is controlled in synchrony with the zero-crossing timing. Further, an image forming apparatus includes a power supply unit that generates a predetermined DC voltage from an AC voltage input from a commercial AC power supply. For the power supply unit, a system is adopted in which a zero-crossing timing detected with a circuit on a primary side on which the AC voltage is input is transmitted to a secondary side, and a controller provided on the secondary side controls electric power supplied to a heater or the like.

In recent years, there are increasing demands to enhance usability and achieve energy savings and the like, and there is a demand to present accurate information to a user and to accurately control the supply of electric power in order to prevent the wasteful supply of power to a heater or the like. Therefore, it is becoming necessary for a power supply unit to transmit not only zero-crossing timing information but also information required for controlling the electric power of a heater or the like to a controller on the secondary side. For example, in Japanese Patent No. 5712186 an embodiment is described in which a power supply state on a primary side is transmitted to a secondary side by a zero-crossing detection signal, and it is determined whether or not the state is a normal state. For example, according to Japanese Patent No. 5712186, information indicating whether or not a power supply from a commercial AC power supply is normal is transmitted to the secondary side by changing the voltage value of a zero-crossing detection signal according to the power supply state. Further, on the secondary side, whether the power supply is in a normal state is determined based on the voltage value of the zero-crossing detection signal.

As described above, in order to more accurately control power supplied to a heater or the like, it is necessary for a power supply unit to transmit not only zero-crossing timing information but also information obtained on the primary side to a controller on the secondary side. Further, it is becoming increasingly necessary for a controller on the secondary side to make practical use of the information received from the power supply unit for controlling the power supply to a heater or the like. In addition, in a case where an abnormality that occurred on the primary side of a power supply unit, for example, a voltage abnormality or a momentary interruption of an AC voltage input from a commercial AC power supply, or a failure or abnormality of an element or the like inside the power supply unit occurs, it is necessary for the secondary-side controller to appropriately notify abnormality detection information to the user. Further, there is a demand to enhance the usability in this way.

Thus, on one hand the information that should be transmitted from the primary side to the secondary side of the power supply unit increases, and on the other hand components for isolating the primary side from the secondary side, for example, a photocoupler or an isolation transformer, are necessary in order to transmit information related to the primary side to the secondary side. When an increase in components due to an increase in the information amount, and also a peripheral circuit for controlling these components is taken into consideration, the problem that there is an increase in cost as well as an increase in the size of the power supply unit arises.

In the configuration described in Japanese Patent No. 5712186, there is a constraint on the amount of information that can be transmitted from the primary side to the secondary side, and it is necessary to further increase the components for isolating the primary side from the secondary side in order to further increase the amount of information transmitted from the primary side to the secondary side. Consequently, this leads to a further increase in cost as well as an increase in the size of the power supply unit.

SUMMARY OF THE INVENTION

In view of these circumstances, an aspect of the present invention is an image forming apparatus that, with a simple configuration, transmits information related to the primary side to the secondary side.

Another aspect of the present invention is an image forming apparatus including a power supply unit configured to generate a DC voltage from an AC voltage and supply the DC voltage to a load, the image forming apparatus configured to perform image formation on a recording material, the image forming apparatus including a first control unit configured to control the image formation on the recording material, the power supply unit including: a second control unit configured to control a voltage generation unit that generates the DC voltage from the AC voltage input from an AC power supply, a zero-crossing detection unit configured to detect a zero-crossing timing of the AC voltage according to the AC voltage input, and to output a zero-crossing detection signal, and a transmission unit configured to transmit the zero-crossing detection signal output from the zero-crossing detection unit to the first control unit, wherein the second control unit superposes information related to a primary side of the voltage generation unit on the zero-crossing detection signal, and transmits the zero-crossing detection signal to the first control unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

Configuration of Image Forming Apparatus

Figure 1:
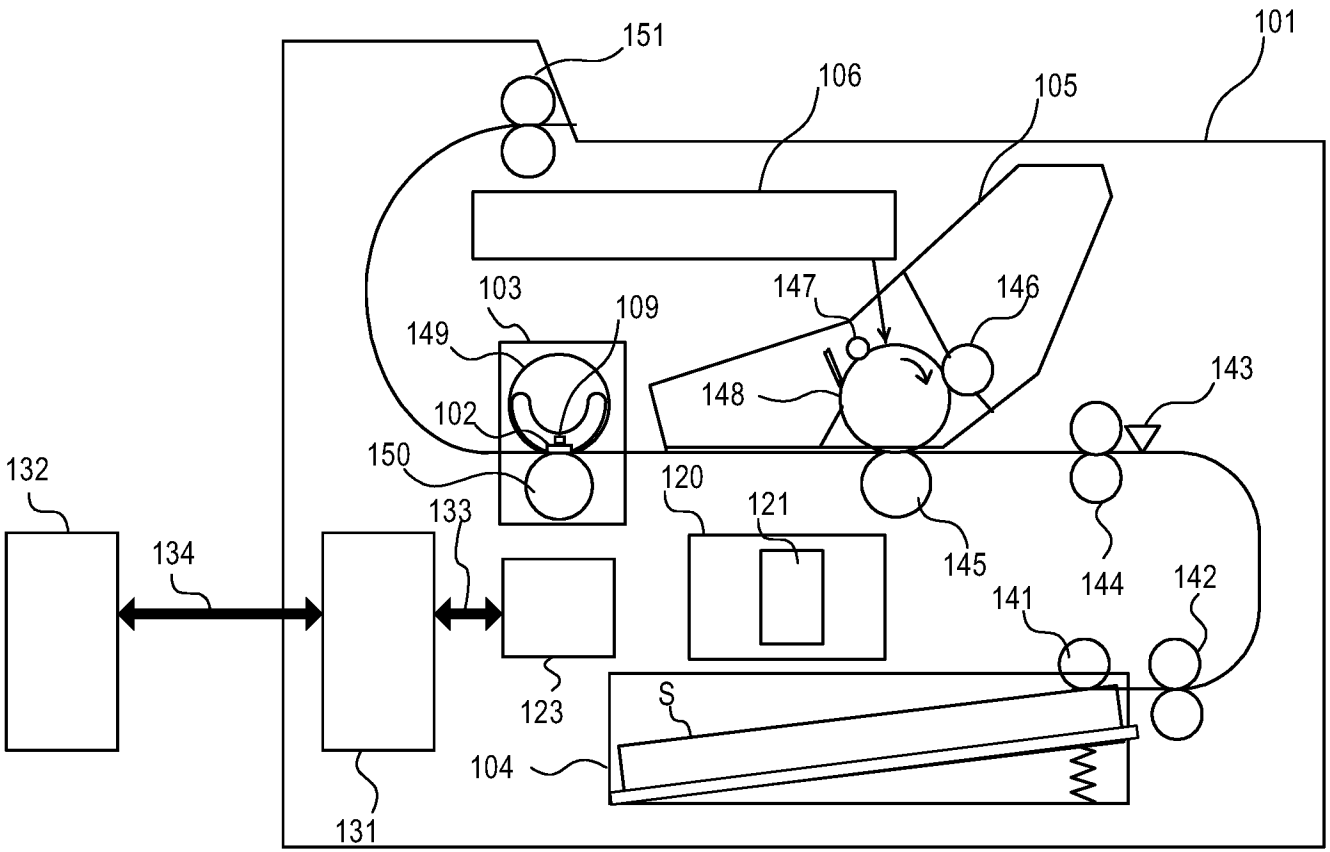
FIG. 1 is a schematic cross-sectional view of an image forming apparatus of Embodiments 1 and 2.

FIG. 1 is a cross-sectional view illustrating a schematic configuration of an image forming apparatus that uses an electrophotographic process. Note that, in the present embodiment, although a configuration of a laser beam printer is described as one example of an image forming apparatus, the image forming apparatus may be a copier, a facsimile machine, a multifunction peripheral or the like.

A laser beam printer 101 (hereinafter, referred to as "printer 101") illustrated in FIG. 1 has a sheet feeding cassette 104 that stores a recording material S that is a recording medium. The printer 101 also has a feeding roller 141 which feeds the recording material S from the sheet feeding cassette 104, a conveyance roller pair 142 and, on the downstream side of the conveyance path, a top sensor 143 which detects a leading end of the recording material S, and a registration roller pair 144 which conveys the recording material S to a transfer roller 145. Further, the printer 101 has, on a downstream side of the conveyance path from the registration roller pair 144, a cartridge unit 105 which forms a toner image on the recording material S according to a laser beam irradiated from a laser scanner 106. The cartridge unit 105 has a photosensitive drum 148, a charging roller 147 and a developing roller 146 which are image bearing members that are required for a well-known electrophotographic process. The charging roller 147 charges the surface of the photosensitive drum 148 to a uniform potential. An electrostatic latent image is formed on the surface of the photosensitive drum 148 that was charged to a uniform potential by the charging roller 147 according to a laser beam irradiated based on image information from the laser scanner 106. The developing roller 146 causes toner to adhere to the electrostatic latent image that was formed on the photosensitive drum 148, to thereby form a toner image. The toner image formed on the photosensitive drum 148 is transferred by the transfer roller 145 onto the recording material S that was conveyed from the sheet feeding cassette 104.

The printer 101 also has, on a downstream side of the conveyance path from the transfer roller 145, a heat fixing device 103 for heat-fixing the toner image that was transferred onto the recording material S to the recording material S. The heat fixing device 103 has a fixing film 149, a pressure roller 150 that contacts against the fixing film 149 and presses the toner image on the recording material S onto the recording material S, and a heater 102 which is arranged inside the fixing film 149 and melts the toner on the recording material S. In addition, the heat fixing device 103 has a thermistor 109 that is a temperature detection unit which is arranged in the vicinity of the heater 102 and which detects the temperature of the heater 102. Further, the printer 101 has a sheet discharging roller pair 151 on the downstream side of the conveyance path from the heat fixing device 103. The recording material S on which the toner image was heat-fixed is discharged by the sheet discharging roller pair 151.

An engine controller 123 (first control unit) is a control unit of the printer 101, and controls a drive unit (not illustrated in the drawings) such as a motor or a clutch to drive the respective rollers and thereby controls the conveyance of the recording material S. In addition, the engine controller 123 controls the laser scanner 106, the cartridge unit 105 and the heat fixing device 103 to carry out control of image formation onto the recording material S. Further, a controller 131 is connected to an external apparatus 132 such as a personal computer through a general-purpose external interface 134 (for example, a USB terminal). The controller 131 receives a print command that includes print information (the number of sheets to be printed and various settings or the like) and data for printing (image information) from the external apparatus 132 through the external interface 134. Upon receiving the print command, the controller 131 expands the data for printing into image data with which image formation is actually enabled, and thereafter the image data with which image formation is enabled is sent from the controller 131 to the laser scanner 106. Furthermore, upon receiving the print command from the external apparatus 132, the controller 131 sends an instruction to perform image formation to the engine controller 123 through an engine interface 133. The engine controller 123 then starts the aforementioned image formation operation.

A power supply unit 120 internally includes a voltage generation unit 121, and generates DC voltages of 3.3 V and 24 V from an AC voltage input from a commercial AC power supply, and supplies the DC voltages to respective apparatuses (load) inside the printer 101. The DC voltage of 3.3 V is supplied to a circuit of a control system including the engine controller 123, the controller 131, a laser emitting unit (not illustrated in the drawings) of the laser scanner 106, and the top sensor 143 or the like. On the other hand, the DC voltage of 24 V is supplied to the aforementioned drive unit, a high voltage power supply that supplies a high voltage to the cartridge unit 105, and a driving unit (not illustrated in the drawings) that drives a rotating polygon mirror that deflects the laser beam of the laser scanner 106 and the like. The power supply unit 120 also outputs a zero-crossing detection signal (to be described in detail later) which includes zero-crossing timing information and the like to the engine controller 123. The engine controller 123 controls a heater switching unit (not illustrated in the drawings) based on zero-crossing timing information of the zero-crossing detection signal from the power supply unit 120 and other information, and supplies an AC voltage from a commercial AC power supply 201 to the heater 102. Further, at such time the engine controller 123 appropriately controls the heater switching unit in synchrony with the zero-crossing timing so as to realize a desired phase angle or duty ratio of the wave number so that the heater 102 becomes a predetermined temperature.

Configuration of Power Supply Unit

Figure 2:
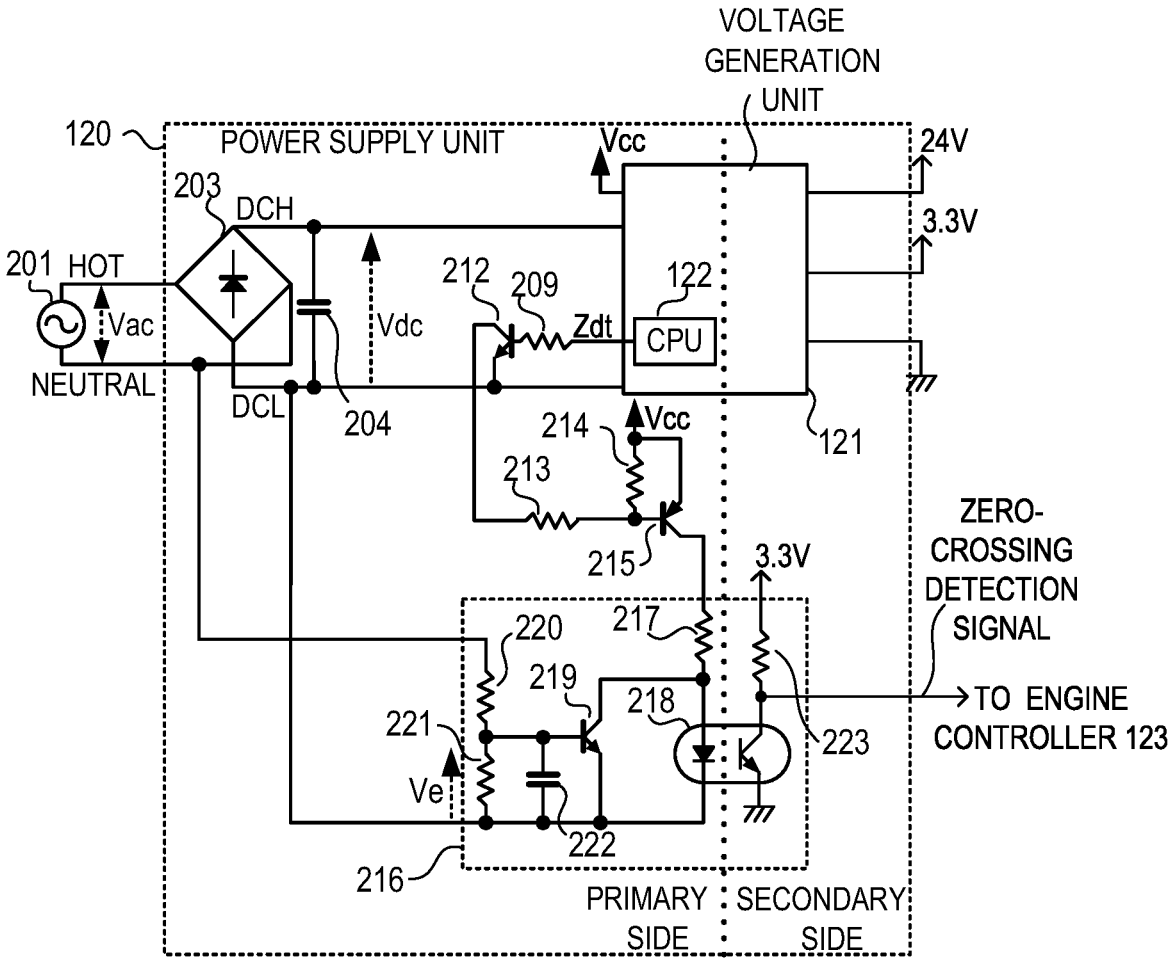
FIG. 2 is a circuit diagram of a power supply unit of Embodiment 1.
Figures 3A, 3B, 3C, 3D:
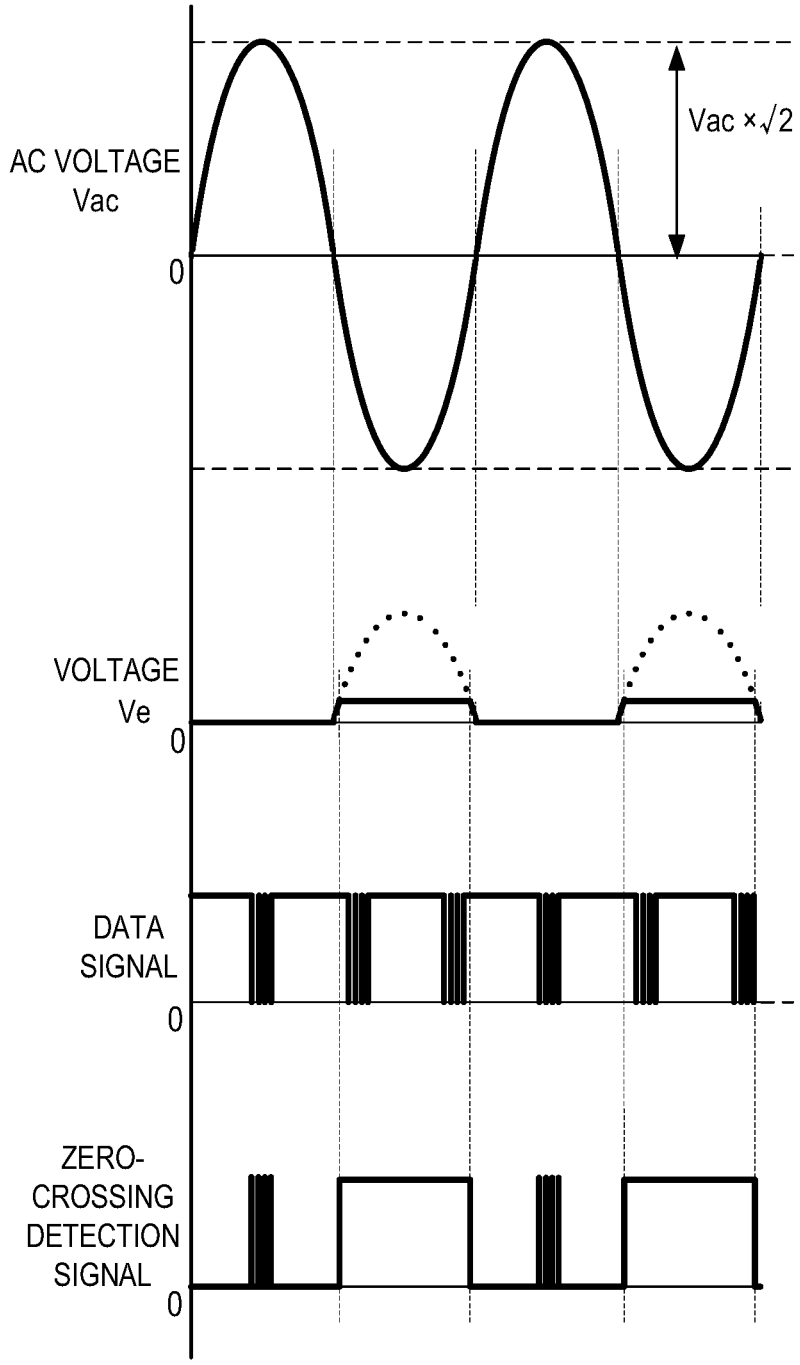
FIGS. 3A, 3B, 3C and 3D are graphs illustrating waveforms relating to respective portions of the power supply unit of Embodiment 1.

FIG. 2 is a circuit diagram illustrating the circuitry of the power supply unit 120 illustrated in FIG. 1. Further, FIG. 3A to FIG. 3D are graphs illustrating voltage waveforms relating to respective portions of the power supply unit 120 illustrated in FIG. 2 and a waveform of a zero-crossing detection signal. FIG. 3A illustrates a voltage waveform of an AC voltage Vac input from the commercial AC power supply 201. Note that, the peak voltage of the AC voltage Vac is, for example, in the case of an AC voltage of 100 V, approximately 141 volts that is a multiple of √2 times the AC voltage Vac. FIG. 3B illustrates a voltage waveform (to be described in detail later) of a voltage Ve indicated by an arrow in FIG. 2. FIG. 3C illustrates a waveform of a DATA signal output from a Zdt terminal to be described later. FIG. 3D illustrates a waveform of a zero-crossing detection signal output to the engine controller 123 from the power supply unit 120. Note that, the abscissa in FIG. 3A to FIG. 3D represents time.

In FIG. 2, the commercial AC power supply 201 outputs the AC voltage Vac (FIG. 3A) to two lines which are a hot line (indicated by "Hot" in FIG. 2) and a neutral line (indicated by "Neutral" in FIG. 2), to supply the AC voltage Vac to the power supply unit 120. The AC voltage Vac input from the commercial AC power supply 201 is rectified at a bridge diode 203 and smoothed by a capacitor 204 as a rectifying and smoothing unit. The smoothed voltage serves as a voltage Vdc based on DCL. The voltage Vdc (DCH/DCL line) is input to the voltage generation unit 121 that outputs DC voltages of 3.3 V and 24 V to the secondary side. The voltage generation unit 121 has a CPU 122 (second control unit) on the primary side. The CPU 122 has a ROM (not illustrated in the drawings) and a RAM (not illustrated in the drawings). The CPU 122 uses the RAM as a work area, and performs control of the power supply unit 120 based on various control programs stored in the ROM so as to generate DC voltages of 3.3 V and 24 V from the input voltage Vdc and output the DC voltages to respective units of the printer 101. The CPU 122 also has a timer for performing time measurement. In addition, a voltage Vcc that is a constant voltage of a comparatively low voltage based on DCL is generated at the voltage generation unit 121 as a power supply voltage for actuating a zero-crossing detection circuit 216 described later. The voltage Vcc is also supplied to other control circuits on the primary side, and not just within the voltage generation unit 121.

The voltage Vcc is supplied through a transistor 215 (first switching element) to the zero-crossing detection circuit 216 which is described later. In the transistor 215, the emitter terminal is connected to the voltage Vcc, and the collector terminal is connected to the zero-crossing detection circuit 216. The base terminal of the transistor 215 is pulled up by the voltage Vcc through a resistance 214, and is also connected to the collector terminal of a transistor 212 through a resistance 213. In the transistor 212, the emitter terminal is connected to the DCL line, and the base terminal is connected to a Zdt terminal of the CPU 122 through a resistance 209. The Zdt terminal is an output terminal of the CPU 122. When the CPU 122 sets the output of the Zdt terminal at High level, the transistor 212 turns on. Thus, the transistor 215 turns on and, as a result, the voltage Vcc is supplied to the zero-crossing detection circuit 216 through the transistor 215. On the other hand, when the CPU 122 sets the output of the Zdt terminal at Low level, the transistor 212 turns off. Thus, the transistor 215 turns off and, as a result, supply of the voltage Vcc to the zero-crossing detection circuit 216 is stopped. By this means, the transistor 215 supplies a voltage to the zero-crossing detection circuit 216, and stops the supply of a voltage to the zero-crossing detection circuit 216. Further, by setting the output of the Zdt terminal at High level or Low level, it is also possible for the CPU 122 to switch the zero-crossing detection signal, to be described later, to High level or Low level. The details are described later.

The engine controller 123 of the printer 101 is capable of switching the operational state of the printer 101 between a stand-by mode in which image formation onto the recording material S is enabled, and a power saving mode in which the printer 101 is set in a sleep mode which does not perform image formation and which reduces power consumption. A signal wire (not illustrated in the drawings) is provided between the engine controller 123 and the CPU 122, and the engine controller 123 notifies the operational state (stand-by mode or power saving mode) of the printer 101 to the CPU 122. When the engine controller 123 notifies the CPU 122 to switch the operational state of the printer 101 to the power saving mode, the CPU 122 sets the output of the Zdt terminal at Low level to thereby turn off the transistor 212 and the transistor 215. By this means, supply of the voltage Vcc to the zero-crossing detection circuit 216 is stopped, and power consumption at the zero-crossing detection circuit 216 can be suppressed. In this case, a configuration may also be adopted in which, together with stopping the supply of the voltage Vcc to the zero-crossing detection circuit 216, it is also possible for the CPU 122 to stop output of the 24 V to further suppress power consumption.

Zero-Crossing Detection Circuit

When the voltage Vcc is being supplied, at a zero-crossing timing at which the AC voltage Vac becomes approximately zero volts, the zero-crossing detection circuit 216 switches the zero-crossing detection signal on the secondary side from High level to Low level, or from Low level to High level. The zero-crossing detection signal is output to the engine controller 123 on the secondary side, and the engine controller 123 can detect the zero-crossing timing.

In the zero-crossing detection circuit 216 illustrated in FIG. 2, resistances 220 and 221 are connected in series between the neutral line and the DCL line, and divide a voltage input from the neutral line is based on the voltage of the DCL line. Further, a capacitor 222 is connected in parallel with the resistance 221, with one end connected to a junction point between the resistance 220 and the resistance 221, and the other end connected to the DCL line. The base terminal of a transistor 219 (second switching element) is connected to the junction point between the resistance 220 and the resistance 221, and to one end of the capacitor 222. The collector terminal of the transistor 219 and an anode terminal of a primary-side LED (light emitting diode) of a photocoupler 218 that is a transmission unit are connected to the collector terminal of the transistor 215 through a resistance 217. On the other hand, the emitter terminal of the transistor 219 and a cathode terminal of the primary-side LED of the photocoupler 218 are connected to the DCL line. In a secondary-side phototransistor of the photocoupler 218, the collector terminal is pull-up connected to the voltage of 3.3 V through a resistance 223, and the emitter terminal is grounded. Note that, the collector terminal of the secondary-side phototransistor of the photocoupler 218 is connected to the engine controller 123, and the voltage of the collector terminal is output as a zero-crossing detection signal.

A voltage Ve that was divided by the resistances 220 and 221 is input to the base terminal of the transistor 219 after unwanted noise has been removed from the voltage Ve by the capacitor 222, and the transistor 219 is turned on or off according to the voltage Ve. In a case where the voltage Ve is equal to or higher than a voltage threshold value of the transistor 219, the transistor 219 turns on, and the voltage Ve input to the base terminal is clamped by the voltage between the base and the emitter (voltage threshold value) of the transistor 219. Therefore, the voltage waveform is a waveform that was clamped by the voltage between the base and the emitter of the transistor 219 as illustrated in FIG. 3B.

When the transistor 215 turns on, the voltage Vcc is supplied to the zero-crossing detection circuit 216 through the transistor 215. When the voltage Vcc is being supplied, the transistor 219 turns on when the voltage Ve exceeds the voltage threshold value of the transistor 219. Thus, the primary-side LED of the photocoupler 218 enters a non-conduction state and does not emit light, and the secondary-side phototransistor also turns off. As a result, the zero-crossing detection signal becomes High level that is a state in which the signal is pulled up by the voltage of 3.3 V through the resistance 223 (FIG. 3D). On the other hand, when the voltage Vcc is being supplied, if the voltage Ve input to the base terminal of the transistor 219 is lower than the voltage threshold value of the transistor 219, the transistor 219 turns off. By this means, the primary-side LED of the photocoupler 218 enters a conduction state and emits light, and the secondary-side phototransistor also turns on. As a result, the zero-crossing detection signal becomes Low level (FIG. 3D). Thus, the zero-crossing detection signal is a signal that repeats switching from High level to Low level or from Low level to High level at the zero-crossing timing of the AC voltage Vac (FIG. 3D).

DATA Signal

Further, during a period in which the transistor 215 is in a turn-on state and the transistor 219 is in a turn-off state, that is, during a period in which the primary-side LED of the photocoupler 218 is emitting light in a conduction state (at this time, the zero-crossing detection signal is Low level), the transistor 215 is turned off. Thus, because the supply of the voltage Vcc that was being supplied through the transistor 215 is stopped, the primary-side LED of the photocoupler 218 enters a non-conduction state and does not emit light, and as a result the zero-crossing detection signal becomes High level. Therefore, in a period in which the transistor 219 is in a turn-off state, the CPU 122 can change the zero-crossing detection signal on the secondary side to High level or Low level by setting the output of the Zdt terminal at High level or Low level (FIG. 3C). That is, the CPU 122 can cause the data (DATA signal) output from the Zdt terminal to be superposed on the zero-crossing detection signal, and can transmit information to the engine controller 123 (FIG. 3D).

In this connection, a period during which it is possible for the aforementioned CPU 122 to superpose the DATA signal on the zero-crossing detection signal and transmit the information to the engine controller 123 is a period during which the transistor 219 is in a turn-off state (FIG. 3C and FIG. 3D). When the transistor 219 is in a turn-off state, the CPU 122 causes the primary-side LED of the photocoupler 218 to emit light (conduction state) or not to emit light (non-conduction state) by switching the output of the Zdt terminal to High level or Low level. By this means, the zero-crossing detection signal on the secondary side output to the engine controller 123 can be changed to Low level or High level. That is, the CPU 122 can superpose the DATA signal on the zero-crossing detection signal output to the engine controller 123 on the secondary side, only when the transistor 219 is in a turn-off state.

However, as illustrated in FIG. 2, the CPU 122 does not have a circuit for detecting the state of the AC voltage Vac. Therefore, since the CPU 122 does not detect a turn-on state or turn-off state of the transistor 219, in the present embodiment a configuration is adopted in which the DATA signal that shows information related to the AC voltage Vac on the primary side is successively output. As a result, the engine controller 123 can superpose information related to the AC voltage Vac only in a case where the DATA signal is output during a period in which the transistor 219 is in a turn-off state and the zero-crossing detection signal is Low level. For example, in a case where the timing at which the CPU 122 outputs the DATA signal from the Zdt terminal is a timing that straddles the zero-crossing timing, a part of the data included in the DATA signal will be lost. Further, in a case where the transistor 219 is in a turn-on state, the zero-crossing detection signal is High level, and the state is one in which the DATA signal is not superposed (FIG. 3C and FIG. 3D).

Thus, because there are some cases in which the DATA signal cannot be correctly superposed in a single zero-crossing detection cycle, in the present embodiment, a cycle in which the DATA signal is output is made sufficiently early in comparison to the power supply frequency of the commercial AC power supply 201. By this means, the cycle in which the DATA signal is output ends in the period in which the zero-crossing detection signal is Low level (that is, period in which the transistor 219 is in a turn-off state), to thereby ensure as much as possible that data missing does not occur.

In the present embodiment, the voltage generation unit 121 internally includes a voltage detection circuit (not illustrated in the drawings). The CPU 122 detects the voltage Vdc input to the voltage generation unit 121 with the voltage detection circuit, and thereby successively calculates the voltage value of the AC voltage Vac of the commercial AC power supply 201. Further, the CPU 122 successively outputs the calculated voltage value data of the AC voltage Vac as the DATA signal from the Zdt terminal (FIG. 3C).

On the other hand, the engine controller 123 internally includes a memory for holding voltage value data related to the AC voltage Vac of the commercial AC power supply 201. Each time that the engine controller 123 normally receives information related to the AC voltage Vac included in the DATA signal superposed on the zero-crossing detection signal, the engine controller 123 updates the voltage value data related to the AC voltage Vac inside the memory. Further, in a case where the engine controller 123 cannot normally receive the DATA signal due to the aforementioned data missing or a sudden signal change caused by noise or the like, the most recent voltage value data related to the AC voltage Vac that was held in the memory is used by the engine controller 123 for control. The engine controller 123 performs control of the supply of power to the heater 102 of the heat fixing device 103 based on the information related to the AC voltage Vac on the primary side held in the memory.

In the foregoing, a configuration in which transmission of the DATA signal to the engine controller 123 is enabled only in a period in which the zero-crossing detection signal is Low level is described. Although in the present embodiment, transmission of the DATA signal is enabled only in a period in which the zero-crossing detection signal is Low level, for example, a circuitry may be adopted so as to enable transmission of the DATA signal only in a period in which the zero-crossing detection signal is High level. In addition, a circuitry may be adopted so as to enable transmission of the DATA signal to the engine controller 123 irrespective of whether the zero-crossing detection signal is High level or Low level.

In the present embodiment, a configuration is described in which the CPU 122 does not detect a turn-on/turn-off state of the transistor 219. For example, a circuitry may be adopted in which the CPU 122 is capable of detecting a turn-on/turn-off state of the transistor 219, and the CPU 122 may be configured to output the DATA signal from the Zdt terminal only in a period in which the transistor 219 is in a turn-off state. By this means, the occurrence of data missing when the DATA signal is superposed on the zero-crossing detection signal as described above can be avoided.

Further, information which the CPU 122 transmits to the engine controller 123 on the secondary side is not limited to the aforementioned information related to the voltage of the AC voltage Vac. For example, the information may be information related to the primary side such as the power supply frequency of the commercial AC power supply 201, an abnormality in the power supply voltage such as a temporary power failure (momentary interruption) or a voltage reduction with respect to the commercial AC power supply 201, another operating state or abnormality of the voltage generation unit 121, or whether or not a failure occurred.

Although in the present embodiment the CPU 122 that controls the voltage generation unit 121 performs control of the Zdt terminal, it is not necessary for a control circuit which controls voltage generation to be limited to the CPU 122 as long as the control circuit is a control circuit (CPU) on the primary side. For example, in a configuration in which a CPU which performs control of the heat fixing device 103 which is other than the aforementioned CPU 122 is provided on the primary side, the CPU which performs control of the heat fixing device 103 may be configured to control the zero-crossing detection signal.

Furthermore, although in the present embodiment the photocoupler 218 is used as means for transmitting a signal from the primary side to the secondary side, means for transmitting a signal from the primary side to the secondary side is not limited to the photocoupler, and for example it suffices that means for transmitting a signal from the primary side to the secondary side is an element which isolates the primary side from the secondary side and is capable of transmitting a signal, such as an isolation transformer. In addition, although in the present embodiment an example is described in which the CPU 122 is used as a control unit on the primary side, the control unit is not limited to a CPU, and for example may be a controlling element that performs digital processing such as a DSP.

Control Sequence of Power Supply Unit

Figure 4:
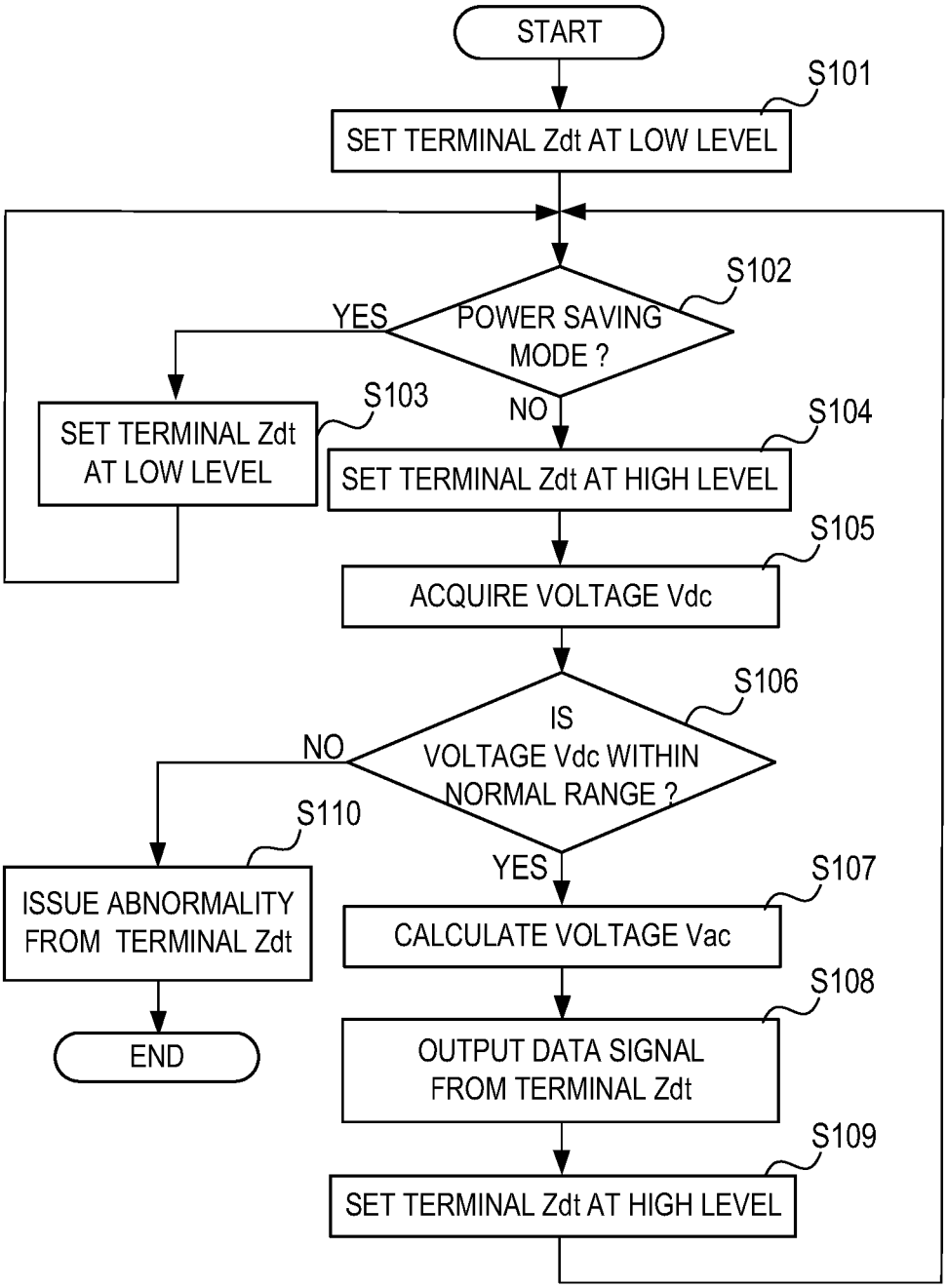
FIG. 4 is a flowchart illustrating a control sequence of the power supply unit of Embodiment 1.

FIG. 4 is a flowchart illustrating a control sequence for superimposing the DATA signal on the zero-crossing detection signal of the power supply unit 120. The processing illustrated in FIG. 4 is executed by the CPU 122 of the power supply unit 120 when the power of the printer 101 is turned on and the CPU 122 is activated. Note that, as described above, information regarding the operational state (stand-by mode or power saving mode) of the printer 101 is transmitted as the need arises by the engine controller 123 to the CPU 122. Further, when the printer 101 is in the power saving mode, supply of the voltage Vcc to the zero-crossing detection circuit 216 is cut off to reduce power consumption. Therefore, when the printer 101 is in the power saving mode, the CPU 122 does not perform operations for detecting an abnormality of the voltage Vdc.

In step (hereinafter, referred to as "S") 101, the CPU 122 sets the output of the Zdt terminal at Low level to stop the supply of the voltage Vcc to the zero-crossing detection circuit 216 so that the zero-crossing detection circuit 216 does not operate. In S102, the CPU 122 determines whether the operational state of the printer 101 that was acquired from the engine controller 123 is the power saving mode. If the CPU 122 determines that the operational state of the printer 101 is the power saving mode, the processing proceeds to S103, while if the CPU 122 determines that the operational state of the printer 101 is not the power saving mode (is the stand-by mode), the processing proceeds to S104. In S103, the CPU 122 sets the output of the Zdt terminal at Low level so that the zero-crossing detection circuit 216 does not operate, and returns the processing to S102.

The CPU 122 sets the output of the Zdt terminal at High level to supply the voltage Vcc to the zero-crossing detection circuit 216 so that the zero-crossing detection circuit 216 operates (S104). In S105, the CPU 122 acquires the voltage Vdc that is the voltage of the capacitor 204. In S106, the CPU 122 determines whether the value of the acquired voltage Vdc is a voltage value within the normal range (is voltage Vdc within normal range?). If the CPU 122 determines that the value of the voltage Vdc is a voltage value within the normal range, the processing proceeds to S107, while if the CPU 122 determines that the value of the voltage Vdc is not a voltage value within the normal range, the processing proceeds to S110.

The CPU 122 calculates the voltage value of the AC voltage Vac of the commercial AC power supply 201 based on the voltage Vdc acquired in S105 (S107). As described above, because the voltage Vdc is the peak voltage of the AC voltage Vac (for example, the peak voltage when the AC voltage is 100 V is approximately 141 V that is a multiple of $\sqrt{2}$ times the AC voltage), the voltage Vac can be calculated, for example, by dividing the voltage Vdc by $\sqrt{2}$. In S108, the CPU 122 converts the value of the voltage Vac calculated in S107 to a corresponding DATA signal and appropriately switches the output of the Zdt terminal to High level or Low level according to the converted DATA signal, and outputs the DATA signal. Upon finishing output of the DATA signal, in S109 the CPU 122 sets the output of the Zdt terminal at High level so that the zero-crossing detection circuit 216 operates, and returns the processing to S102.

In S110, in order to transmit information indicating the abnormality in the voltage Vdc to the engine controller 123, the CPU 122 outputs a DATA signal corresponding to the abnormality in the voltage Vdc to the Zdt terminal, and then ends the processing. By this means, a DATA signal indicating the voltage abnormality in the voltage Vdc is superposed on the zero-crossing detection signal, and is output. Upon being notified of the voltage abnormality in the voltage Vdc on the primary side by receiving the DATA signal from the CPU 122, if a print operation is in progress, the engine controller 123 cancels the image formation operation. The engine controller 123 then displays information to the effect that an abnormality occurred in the commercial AC power supply 201 on a display apparatus (not illustrated in the drawings) such as a panel to notify the user of the abnormality.

As described above, according to the present embodiment, information related to the primary side can be transmitted to the secondary side using a simple configuration.

Embodiment 2

In Embodiment 1, an embodiment was described in which a DATA signal indicating a voltage value of the AC voltage Vac which was detected by the CPU 122 is superposed on a zero-crossing detection signal that a zero-crossing detection circuit outputs, and the information is transmitted to the engine controller 123 on the secondary side. In Embodiment 2, an embodiment will be described in which a CPU on the primary side detects a zero-crossing timing, and outputs a zero-crossing detection signal that includes the zero-crossing timing and information related to the AC voltage Vac. Note that, the configuration of the printer 101 as an image forming apparatus and the image formation operations are similar to Embodiment 1, and the same reference numerals are used to denote the same components as in Embodiment 1, and a description of the same configuration and image formation operations as in Embodiment 1 is omitted here.

Configuration of Power Supply Unit

Figure 5:
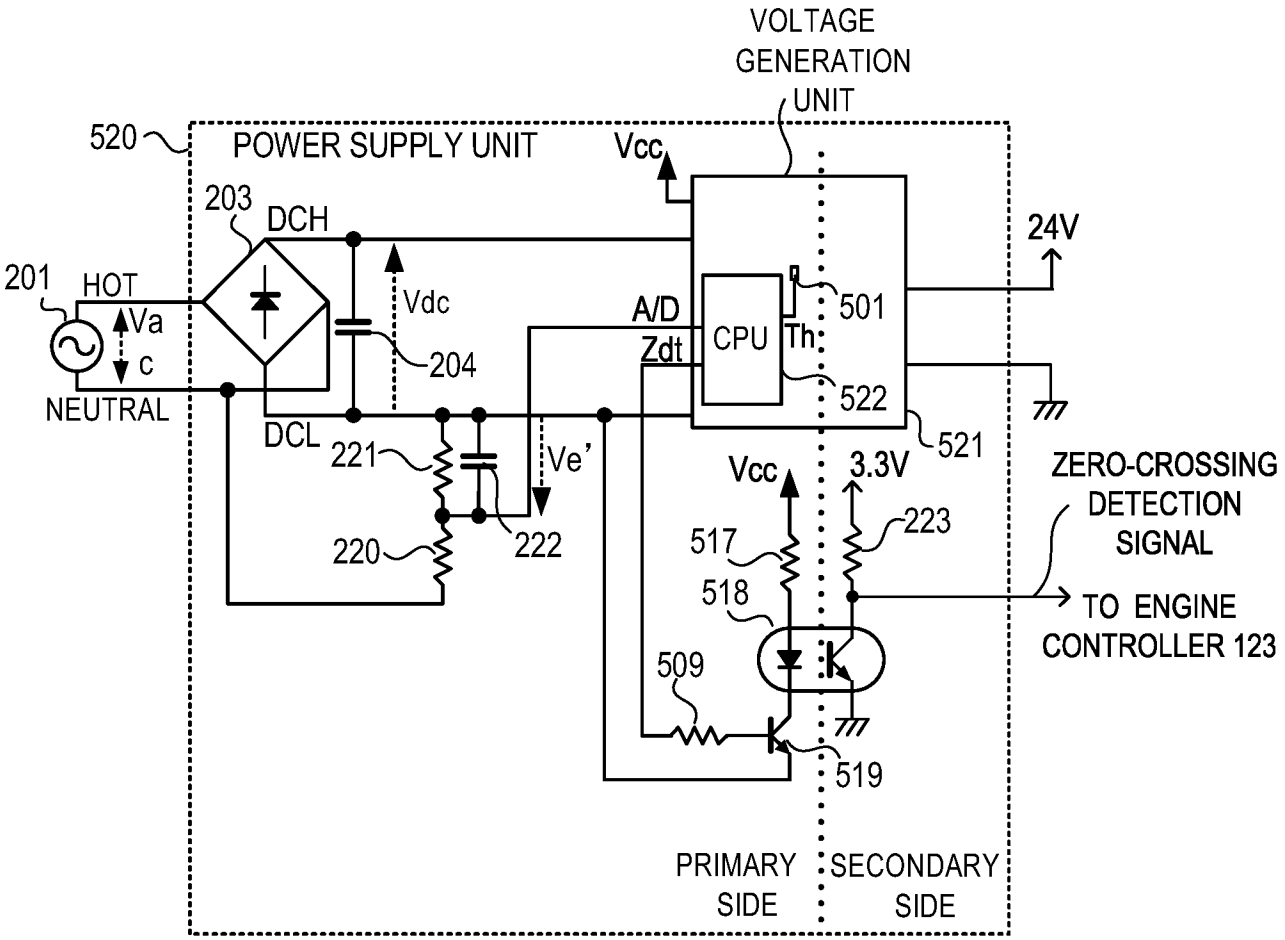
FIG. 5 is a circuit diagram of a power supply unit of Embodiment 2.
Figures 6A, 6B, 6C, 6D, 6E:
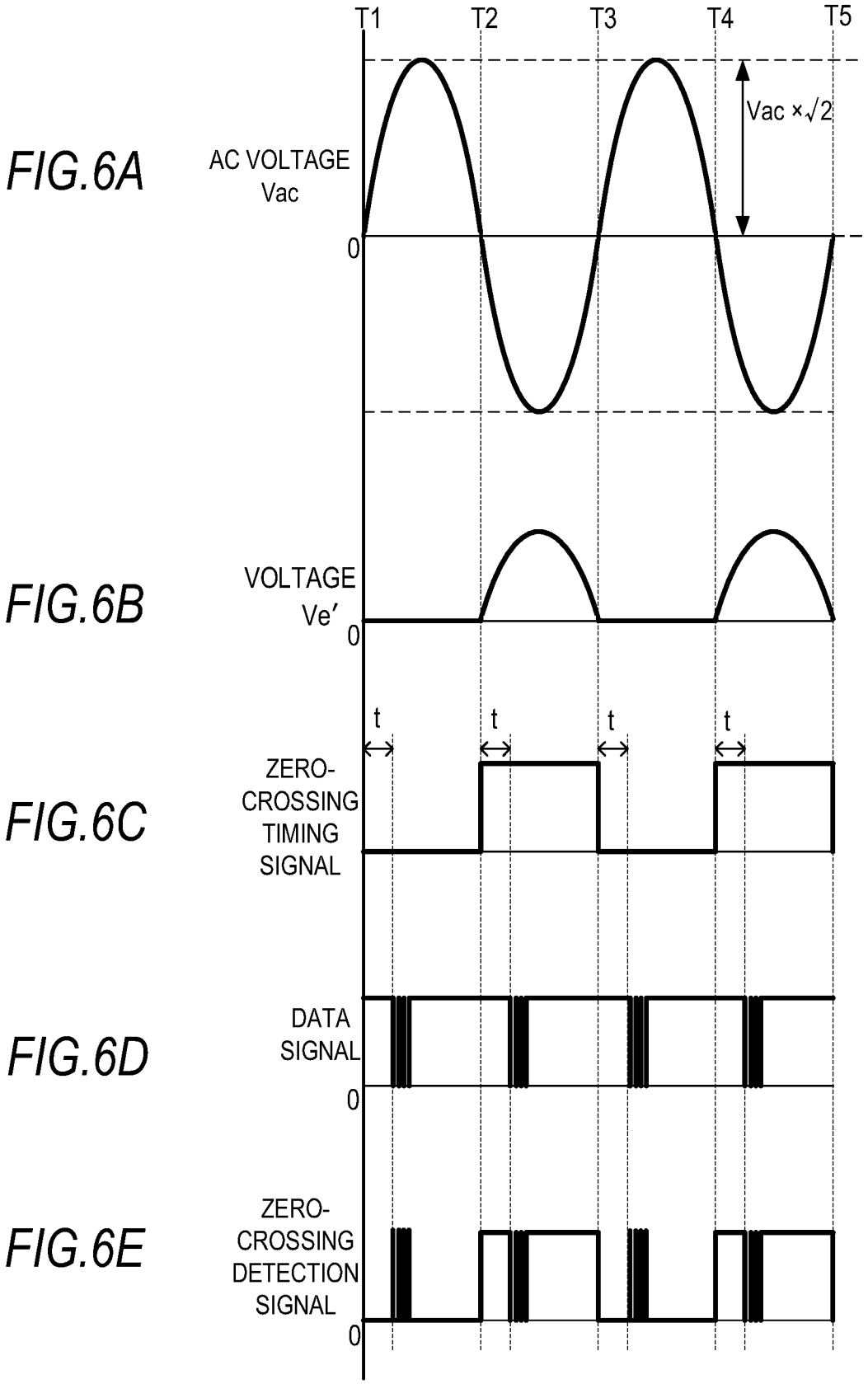
FIGS. 6A, 6B, 6C, 6D and 6E are graphs illustrating waveforms relating to respective portions of the power supply unit of Embodiment 2.

FIG. 5 is a circuit diagram illustrating the circuitry of a power supply unit 520 of the present embodiment. FIGS. 6A, 6B, 6C, 6D and 6E are graphs illustrating voltage waveforms relating to respective portions in the power supply unit 520 illustrated in FIG. 5 and the waveform of a zero-crossing detection signal. FIG. 6A illustrates a voltage waveform of an AC voltage Vac input from the commercial AC power supply 201. FIG. 6B illustrates a voltage waveform of a voltage Ve' obtained when a voltage of a neutral line based on DCL is divided by the resistances 220 and 221. FIG. 6C illustrates a zero-crossing timing signal generated inside a CPU 522. FIG. 6D illustrates a waveform of a DATA signal generated inside the CPU 522. FIG. 6E illustrates a waveform of a zero-crossing detection signal output from the power supply unit 520 to the engine controller 123. Note that, in FIGS. 6A, 6B, 6C, 6D and 6E, the abscissa represents time, and T1, T2, T3, T4, T5 represent zero-crossing timings at which the voltage value of the AC voltage Vac is 0 V.

The circuitry illustrated in FIG. 5 differs from the circuitry illustrated in FIG. 2 of Embodiment 1 in the following points. That is, the circuitry illustrated in FIG. 5 differs from the circuitry of Embodiment 1 in that the voltage Ve' which was divided by the resistances 220 and 221 is input to the CPU 522 of a voltage generation unit 521, and that control of a photocoupler 518 that outputs a zero-crossing detection signal is performed by the CPU 522. In addition, the circuitry illustrated in FIG. 5 differs from the circuitry of Embodiment 1 in that the CPU 522 monitors the temperature of a temperature detecting element 501 connected to a Th terminal (this point is described in detail later).

In FIG. 5, the voltage generation unit 521 has the CPU 522 on the primary side, and the CPU 522 performs control of the power supply unit 520 so as to generate DC voltages of 3.3 V and 24 V based on an input voltage Vdc, and output the DC voltages to respective units of the printer 101. Further, at the voltage generation unit 521, a voltage Vcc that is a comparatively low voltage based on a DCL line is generated as a power supply voltage for actuating the photocoupler 518. The voltage Vcc is also supplied to other control circuits on the primary side, and not just within the voltage generation unit 121.

In FIG. 5, similarly to FIG. 2 of Embodiment 1, resistances 220 and 221 are connected in series between a neutral line and the DCL line, and divide a voltage input from the neutral line based on the voltage of the DCL line. After the capacitor 222 removes unwanted noise from a voltage Ve' that was divided by the resistances 220 and 221, the voltage Ve' is input to an A/D terminal that is an analog-digital conversion input port of the CPU 522. The voltage Ve' input to the A/D terminal of the CPU 522 at this time has a voltage waveform illustrated in FIG. 6B. The CPU 522 detects timings at which the voltage Ve' input from the A/D terminal becomes 0 V, that is, detects zero-crossing timings of the AC voltage Vac, which are indicated by reference characters T1, T2, T3, T4 and T5 in FIGS. 6A, 6B, 6C, 6D and 6E. The CPU 522 generates a signal that switches from High level to Low level or from Low level to High level at a zero-crossing timing, that is, a zero-crossing timing signal, inside the CPU 522 (FIG. 6C).

In FIG. 5, the Zdt terminal of the CPU 522 is connected to the base terminal of a transistor 519 through a resistance 509. In the transistor 519, the collector terminal is connected to a cathode terminal of a primary-side LED of the photocoupler 518, and the emitter terminal is connected to the DCL line. On the other hand, an anode terminal of the primary-side LED of the photocoupler 518 is pull-up connected to the voltage Vcc through a resistance 517. The collector terminal of a secondary-side phototransistor of the photocoupler 518 is pull-up connected to the voltage of 3.3 V through a resistance 223, and the emitter terminal is grounded.

When the CPU 522 sets the output of the Zdt terminal at High level, the transistor 519 enters a turn-on state, the primary-side LED of the photocoupler 518 enters a conduction state and emits light, and the secondary-side phototransistor of the photocoupler 518 also enters a turn-on state. As a result, the signal output to the engine controller 123, that is, the zero-crossing detection signal, becomes Low level. On the other hand, when the CPU 522 sets the output of the Zdt terminal at Low level, the transistor 519 enters a turn-off state, the primary-side LED of the photocoupler 518 enters a non-conduction state and does not emit light, and the secondary-side phototransistor of the photocoupler 518 also enters a turn-off state. As a result, the zero-crossing detection signal output to the engine controller 123 becomes High level. Thus, by the CPU 522 setting the output from the Zdt terminal at High level or at Low level, a zero-crossing detection signal of Low level or of High level is output to the engine controller 123 on the secondary side through the photocoupler 518.

In the present embodiment, similarly to Embodiment 1, the voltage generation unit 521 internally includes a voltage detection circuit (not illustrated in the drawings). The CPU 522 successively calculates the AC voltage Vac of the commercial AC power supply 201 by detecting the voltage Vdc input to the voltage generation unit 521 using the voltage detection circuit. In addition, in the present embodiment, the CPU 522 also calculates a power supply frequency of the AC voltage Vac by detecting the timing at which the voltage input from the A/D terminal becomes 0 volts, and calculating the cycle at which the voltage becomes 0 volts. Further, after a time period t that is a predetermined time period elapses from the zero-crossing timing (FIG. 6C), the CPU 522 generates a DATA signal including the calculated voltage value and power supply frequency data of the AC voltage Vac inside the CPU 522 (FIG. 6D). The CPU 522 then superposes the DATA signal (FIG. 6D) on the zero-crossing timing (FIG. 6C), and outputs the resulting signal as a zero-crossing detection signal from the Zdt terminal (FIG. 6E). Thus, by synchronizing the output timing of the DATA signal with respect to the zero-crossing timing, the engine controller 123 can know in advance the timing at which the DATA signal superposed on the zero-crossing detection signal and output will be received. Therefore, even if the engine controller 123 receives the influence of a sudden waveform change due to noise or the like when receiving the DATA signal, the reception of a normal DATA signal by the engine controller 123 is facilitated. Note that, instead of using the above-described method that synchronizes the output timing of the DATA signal with the zero-crossing timing, a configuration may be adopted in which, for example, similarly to Embodiment 1, the output timing of the DATA signal is a timing unrelated to the zero-crossing timing.

Further, in FIG. 5, the temperature detecting element 501 is connected to the Th terminal of the CPU 522. The temperature detecting element 501 detects the temperature of heat generating elements (for example, an element whose temperature increases when operating, for example, a transformer or an FET (field effect transistor)) arranged inside the voltage generation unit 521. Based on the temperature detected by the temperature detecting element 501, the CPU 522 determines whether or not the temperature of the elements inside the voltage generation unit 521 is within a normal range. If the temperature detected by the temperature detecting element 501 exceeds the normal range due to some kind of abnormality, the CPU 522 determines that there is a temperature abnormality. The CPU 522 then superposes a DATA signal (FIG. 6D) notifying that there is a temperature abnormality on the zero-crossing timing signal (FIG. 6C) output at the zero-crossing timing from the Zdt terminal, to thereby notify the temperature abnormality to the engine controller 123. Upon being notified of the abnormal heat generation of the heat generating element on the primary side by the DATA signal superposed on the zero-crossing detection signal from the CPU 522, the engine controller 123 stops the image formation operation. The engine controller 123 then displays information to the effect that an abnormality occurred in the voltage generation unit 521 of the power supply unit 520 on a display apparatus (not illustrated in the drawings) such as a panel to notify the user of the abnormality.

Note that, the CPU 522 may appropriately change the timing for transmitting information to the secondary side. For example, a configuration may be adopted in which the CPU 522 transmits data that does not directly relate to image formation operations to the engine controller 123 during the stand-by mode in which image formation is not being performed. Further, for example, a configuration may be adopted in which the CPU 522 transmits information related to the AC voltage Vac that relates to image formation operations to the engine controller 123 at all times, including during image formation.

Control Sequence of Power Supply Unit

Figures 7, 7A:
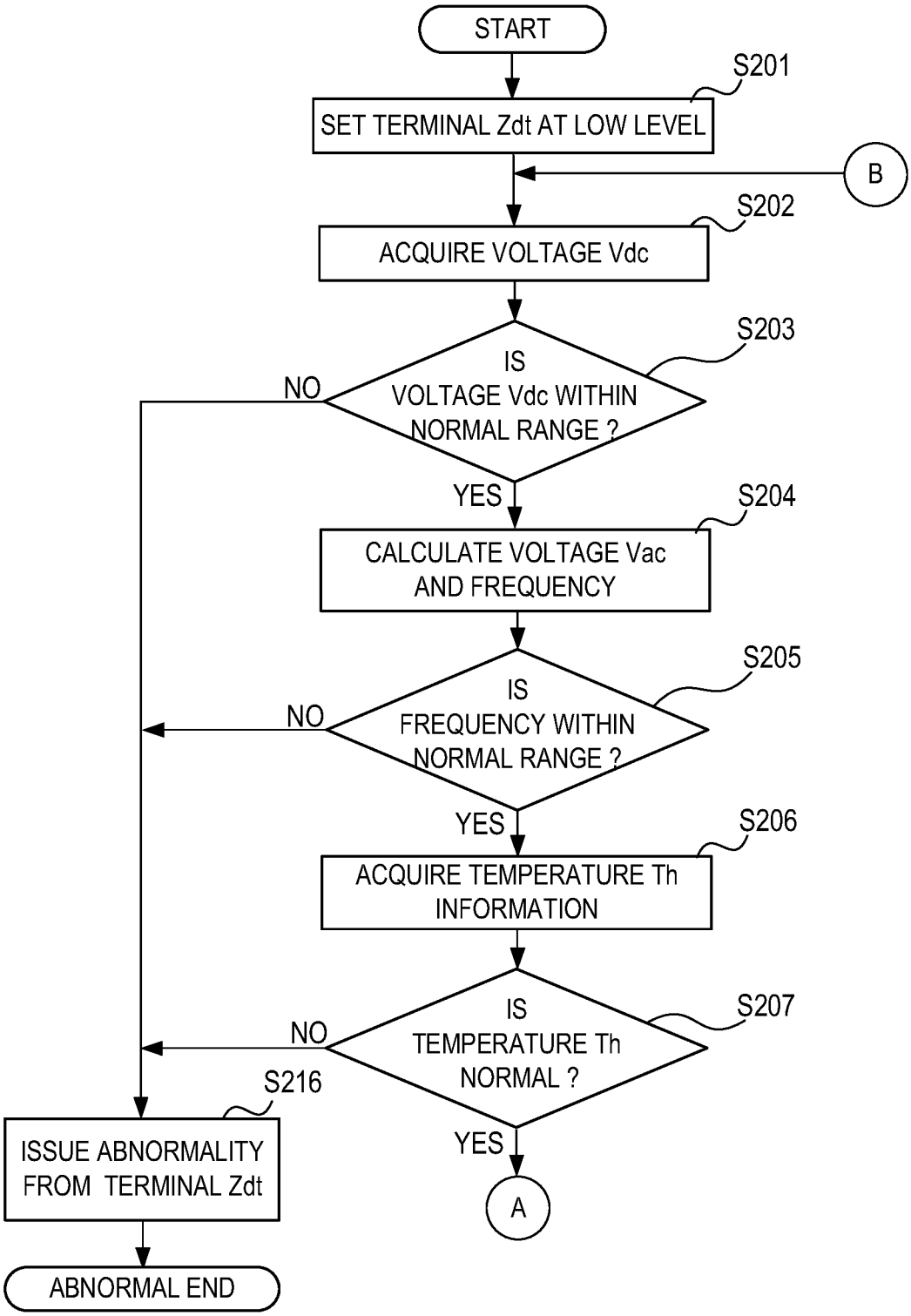
FIG. 7, which is comprised of FIGS. 7A, and 7B, is a flowchart illustrating a control sequence of the power supply unit of Embodiment 2.
Figures 7, 7B:
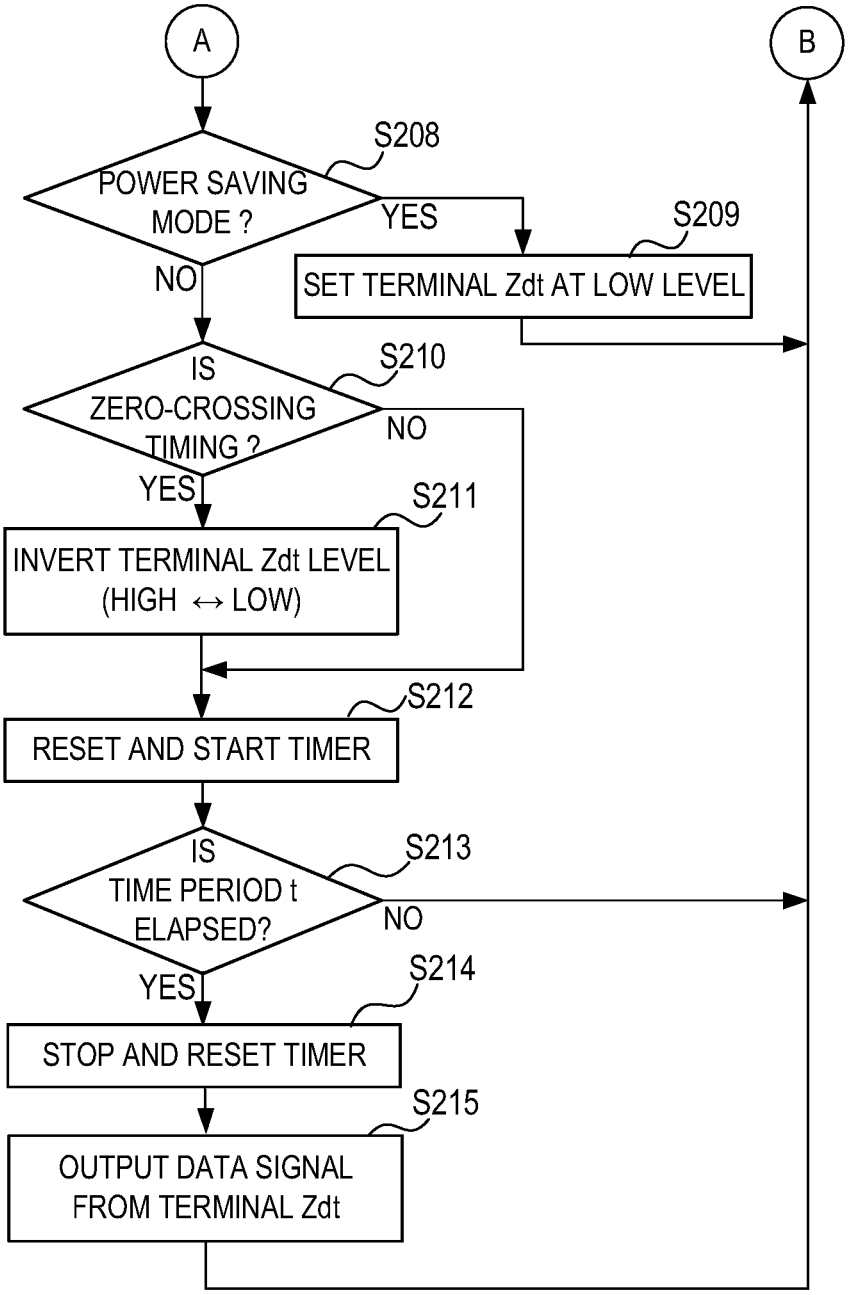

FIG. 7, which is comprised of FIGS. 7A and 7B, is a flowchart illustrating a control sequence for superimposing the DATA signal on the zero-crossing detection signal of the power supply unit 520. The processing illustrated in FIG. 7 is executed by the CPU 522 of the power supply unit 520 when the power of the printer 101 is turned on and the CPU 522 is activated. Note that, as described above, information regarding the operational state (stand-by mode or power saving mode) of the printer 101 is transmitted as the need arises by the engine controller 123 to the CPU 522. Further, according to Embodiment 1, when the printer 101 is in the power saving mode, supply of the voltage Vcc to the zero-crossing detection circuit 216 is cut off to reduce power consumption. Therefore, in the power saving mode the CPU 122 does not perform operations for detecting an abnormality of the voltage Vdc. In contrast, in the present embodiment, the CPU 522 outputs a zero-crossing detection signal according to a zero-crossing timing. Therefore, the CPU 522 performs operations for detecting an abnormality of the voltage Vdc also when in the power saving mode in which the zero-crossing detection signal is not output, and when an abnormality is detected, the CPU 522 performs an operation to notify the abnormality to the engine controller 123.

First, the CPU 522 sets the output of the Zdt terminal at Low level so as not to output the zero-crossing detection signal (S201). Next, the CPU 522 acquires the voltage Vdc that is the voltage of the capacitor 204 (S202). The CPU 522 determines whether the value of the acquired voltage Vdc is a voltage value within a normal range (is voltage Vdc within normal range?) (S203). If the CPU 522 determines that the value of the voltage Vdc is a voltage value within the normal range, the processing proceeds to S204, while if the CPU 522 determines that the value of the voltage Vdc is not a voltage value within the normal range, the processing proceeds to S216.

Based on the voltage Vdc acquired in S202, the CPU 522 calculates the voltage value of the AC voltage Vac of the commercial AC power supply 201, and also calculates the frequency of the AC voltage Vac (S204). As mentioned above, because the voltage Vdc is the peak voltage of the AC voltage Vac (for example, the peak voltage in a case where the AC voltage is 100 V will be approximately 141 V that is a multiple of $\sqrt{2}$ times the AC voltage), the voltage Vac can be calculated by dividing the voltage Vdc by $\sqrt{2}$. Further, based on the voltage value of the voltage Ve' input from the A/D port, the CPU 522 calculates the power supply frequency of the AC voltage Vac input from the commercial AC power supply 201. Here, the CPU 522 stores timings at which the voltage of the voltage Ve' input from the A/D port becomes 0 V in the RAM, and calculates the power supply frequency based on a cycle determined based on the next timing at which the voltage of the voltage Ve' becomes 0 V from the previous timing at which the voltage of the voltage Ve' became 0 V. The CPU 522 then determines whether or not the frequency of the power supply of the AC voltage Vac is within the normal range (S205). If the CPU 522 determines that the power supply frequency of the AC voltage Vac is within the normal range, the processing proceeds to S206, while if the CPU 522 determines that the power supply frequency of the AC voltage Vac is not within the normal range, the processing proceeds to S216.

The CPU 522 acquires temperature information from the temperature detecting element 501 connected to the Th terminal (S206). Based on the acquired temperature information, the CPU 522 determines whether a temperature Th of an element inside the voltage generation unit 521 is within the normal range (S207). If the CPU 522 determines that the temperature in the acquired temperature information is within the normal range, the processing proceeds to S208, while if the CPU 522 determines that the temperature in the acquired temperature information is not within the normal range (is abnormal), the processing proceeds to S216.

The CPU 522 determines whether the operational state of the printer 101 acquired from the engine controller 123 is the power saving mode (S208). If the CPU 522 determines that the operational state of the printer 101 is the power saving mode, the processing proceeds to S209, while if the CPU 522 determines that the operational state of the printer 101 is not the power saving mode (is the stand-by mode or print mode), the processing proceeds to S210. The CPU 522 sets the output of the Zdt terminal at Low level so as not to output the zero-crossing detection signal, and returns the processing to S202 (S209). The CPU 522 determines whether the current timing is the zero-crossing timing, based on the voltage value of the voltage Ve' input from the A/D port (S210). If the voltage of the voltage Ve' is 0 V, the CPU 522 determines that the current timing is the zero-crossing timing, and advances the processing to S211, while if the voltage of the voltage Ve' is not 0 V, the CPU 522 determines that the current timing is not the zero-crossing timing, and returns the processing to S202.

The CPU 522 inverts the voltage level of the Zdt terminal (S211). Specifically, if the zero-crossing detection signal that was most recently output from the Zdt terminal was at High level, the CPU 522 outputs a zero-crossing detection signal of Low level. On the other hand, if the zero-crossing detection signal that was most recently output from the Zdt terminal was at Low level, the CPU 522 outputs a zero-crossing detection signal of High level. The CPU 522 resets and starts the timer in order to detect the timing (time period t) at which the DATA signal is output (S212).

The CPU 522 refers to the timer and determines whether the time period t elapsed (S213). If the CPU 522 refers to the timer and determines that the time period t elapsed, the processing proceeds to S214, while if the CPU 522 refers to the timer and determines that the time period t has not elapsed, the processing returns to S202. The CPU 522 stops and resets the timer (S214). The CPU 522 creates a DATA signal including voltage value information and power supply frequency information of the voltage Vac, and in order to notify the engine controller 123, CPU 522 superposes the DATA signal on the zero-crossing detection signal output from the Zdt terminal, and then returns the processing to S202 (S215). Note that, upon receiving the DATA signal superposed on the zero-crossing detection signal, the engine controller 123 updates voltage value data and frequency data of the AC voltage Vac held in an internal memory.

The CPU 522 outputs a DATA signal for issuing an abnormality of the power supply unit 520 from the Zdt terminal, to thereby notify the abnormality to the engine controller 123 (S216). More specifically, in a case where a voltage abnormality of the voltage Vdc was detected in S203, the CPU 522 outputs a DATA signal corresponding to the voltage abnormality of the voltage Vdc from the Zdt terminal, and then ends the processing. In a case where an abnormality in the power supply frequency of the AC voltage Vac was detected in S205, the CPU 522 outputs a DATA signal corresponding to the power supply frequency abnormality from the Zdt terminal, and then ends the processing. Further, in a case where a temperature abnormality was detected by the temperature detecting element 501 in S207, the CPU 522 outputs a DATA signal corresponding to the temperature abnormality from the Zdt terminal, and then ends the processing. On the other hand, upon being notified of a voltage abnormality of the voltage Vdc or a temperature abnormality on the primary side from the CPU 522, the engine controller 123 cancels the image formation operation if a print operation is in progress. The CPU 522 then displays information to the effect that an abnormality or the like occurred in the commercial AC power supply 201 on a display apparatus (not illustrated in the drawings) such as a panel to notify the user of the abnormality.

As described above, in the present embodiment, a simple circuit is provided, and information which the CPU 122 on the primary side possesses, for example, voltage Vac information, frequency information, or abnormal heat generation information is superposed on the zero-crossing detection signal so that not only the zero-crossing detection signal, but also the superposed information is transmitted to the secondary side. Thus, information which the power supply unit 520 possesses can be transmitted from the primary side of the power supply unit to the engine controller 123 on the secondary side.

As described above, according to the present embodiment, information related to the primary side can be transmitted to the secondary side using a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-004842, filed Jan. 16, 2020, which is hereby incorporated by reference herein in its entirety.

What is claimed is:

1. An image forming apparatus comprising a power supply unit configured to generate a DC voltage from an AC voltage and supply the DC voltage to a load, the image forming apparatus configured to perform image formation on a recording material, the image forming apparatus including a first control unit configured to control the image formation on the recording material, the power supply unit including:

a second control unit configured to control a voltage generation unit that generates the DC voltage from the AC voltage input from an AC power supply, a zero-crossing detection unit configured to detect a zero-crossing timing of the AC voltage according to the AC voltage input, and to output a zero-crossing detection signal, and a transmission unit configured to transmit the zero-crossing detection signal output from the zero-crossing detection unit to the first control unit, wherein the second control unit is configured to obtain information related to a primary side of the voltage generation unit and convert the information related to the primary side to a corresponding signal with a shorter cycle than a cycle of the zero-crossing detection signal, and wherein the second control unit is configured to superpose the corresponding signal on the zero-crossing detection signal, and the transmission unit is configured to transmit the zero-crossing detection signal to the first control unit.

2. The image forming apparatus according to claim 1, wherein the first control unit is capable of switching a state of the image forming apparatus between a stand-by mode in which image formation onto a recording material is enabled, and a power saving mode that does not perform the image formation, and wherein the transmission unit is configured to transmit the zero-crossing detection signal to the first control unit in the stand-by mode, and is configured not to output the zero-crossing detection signal to the first control unit in the power saving mode.

3. The image forming apparatus according to claim 2,
wherein the transmission unit is a photocoupler including a light emitting diode on a primary side of the voltage generation unit and a phototransistor on a secondary side of the voltage generation unit;
wherein the power supply unit includes a first switching element configured to set the light emitting diode in a conduction state or a non-conduction state; and
wherein the second control unit is configured to control the first switching element to set the light emitting diode into the conduction state in the stand-by mode, and to set the light emitting diode into the non-conduction state in the power saving mode.

4. The image forming apparatus according to claim 3,
wherein the zero-crossing detection unit includes a second switching element connected in parallel with the light emitting diode, the second switching element being set to a turn-on state or a turn-off state according to the AC voltage;
wherein the second switching element is set to the turn-off state in a case where the AC voltage is lower than a voltage threshold value of the second switching element, and is set to the turn-on state in a case where the AC voltage is equal to or higher than the voltage threshold value of the second switching element; and
wherein the light emitting diode is configured to enter the conduction state in a case where the second switching element is in the turn-off state, and enters the non-conduction state in a case where the second switching element is in the turn-on state.

5. The image forming apparatus according to claim 4, wherein the second control unit is configured to superpose the corresponding signal on the zero-crossing detection signal by setting the first switching element to the turn-on state or the turn-off state according to the corresponding signal into which the information related to the primary side is converted.

6. The image forming apparatus according to claim 5,
wherein the power supply unit includes a rectifying and smoothing unit that configured to rectify and smooth the AC voltage; and
wherein in a case where a DC voltage output from the rectifying and smoothing unit is not within a normal range, the second control unit is configured to superpose a signal corresponding to a voltage abnormality on the zero-crossing detection signal.

7. The image forming apparatus according to claim 1,
wherein the zero-crossing detection unit is the second control unit; and
wherein the second control unit is configured to output the zero-crossing detection signal to the transmission unit in response to detecting the zero-crossing timing of the AC voltage based on the AC voltage input to the second control unit.

8. The image forming apparatus according to claim 7, wherein the second control unit is configured to superpose the corresponding signal on the zero-crossing detection signal at a timing that does not overlap with the zero-crossing timing of the zero-crossing detection signal, and the transmission unit is configured to transmit the zero-crossing detection signal to the first control unit.

9. The image forming apparatus according to claim 8,
wherein the power supply unit includes a rectifying and smoothing unit that configured to rectify and smooth the AC voltage; and
wherein in a case where a DC voltage output from the rectifying and smoothing unit is not within a normal range, the second control unit is configured to superpose a signal corresponding to a voltage abnormality on the zero-crossing detection signal and outputs the zero-crossing detection signal to the transmission unit.

10. The image forming apparatus according to claim 9,
wherein the power supply unit includes a temperature detection device that is configured to detect a temperature of the voltage generation unit, and
wherein in a case where the temperature acquired from the temperature detection device is not within a normal range, the second control unit is configured to superpose a signal corresponding to a temperature abnormality on the zero-crossing detection signal and outputs the zero-crossing detection signal to the transmission unit.

11. The image forming apparatus according to claim 10, wherein the transmission unit is a photocoupler including a light emitting diode on a primary side of the voltage generation unit and a phototransistor on a secondary side of the voltage generation unit.

12. The image forming apparatus according to claim 1, wherein the information related to the primary side is a value of an AC voltage input from the AC power supply and a power supply frequency.

13. The image forming apparatus according to claim 1, wherein the zero-crossing detection signal varies alternately at between a high level and a low level, wherein the corresponding signal is a set of plural pulse-signals having a predetermined level and
wherein a period in which one set of the plural pulse-signals is output is shorter than a half-cycle period of the zero-crossing detection signal.

14. The image forming apparatus according to claim 13, wherein the predetermined level is the high level, and the one set of the plural pulse-signals is output while the zero-crossing detection signal is the low level.

15. The image forming apparatus according to claim 1, wherein the second control unit is configured to the obtain information related to the primary side of the voltage generation unit from the AC voltage input.

* * * * *